US005249020A

United States Patent [19]

Takano

[11] Patent Number: 5,249,020

[45] Date of Patent: Sep. 28, 1993

[54] DEVELOPING DEVICE FOR ELECTROPHOTOGRAPHIC IMAGE RECORDING APPARATUS

[75] Inventor: Masatoshi Takano, Akikawa, Japan

[73] Assignee: Asahi Kogaku Kogyo Kabushiki Kaisha, Tokyo, Japan

[21] Appl. No.: 721,839

[22] Filed: Jun. 26, 1991

[30] Foreign Application Priority Data

Jun. 27, 1990 [JP] Japan ..... 2-68317[U]
Jul. 2, 1990 [JP] Japan ..... 2-70604[U]
Aug. 21, 1990 [JP] Japan ..... 2-219340

[51] Int. Cl.[5] ..... G03G 15/06
[52] U.S. Cl. ..... 355/260; 222/DIG. 1
[58] Field of Search ..... 355/260, 245; 222/DIG. 1

[56] References Cited

U.S. PATENT DOCUMENTS

| | | | |
|---|---|---|---|
| 4,060,105 | 11/1977 | Feldeisen et al. | 222/DIG. 1 |
| 4,435,065 | 3/1984 | Wada | 355/245 |
| 4,491,161 | 1/1985 | Tamura et al. | 222/DIG. 1 |
| 4,601,259 | 7/1986 | Yamashita | 355/260 X |
| 4,615,608 | 10/1986 | Mizutani | 355/245 X |
| 4,650,097 | 3/1987 | Hagihara et al. . | |
| 4,833,501 | 5/1989 | Buyukguclu . | |
| 4,895,104 | 1/1990 | Yoshino et al. | 355/260 X |
| 4,930,684 | 6/1990 | Patterson | 222/DIG. 1 |
| 4,931,838 | 6/1990 | Ban et al. | 355/260 |
| 4,954,844 | 9/1990 | Morita et al. | 355/260 |
| 4,967,234 | 10/1990 | Tani et al. | 355/260 |
| 4,982,242 | 1/1991 | Ishii et al. | 355/260 X |
| 4,984,023 | 1/1991 | Yoshida | 355/260 |
| 4,997,016 | 3/1991 | Hacknauer et al. | 222/DIG. 1 |
| 5,018,560 | 5/1991 | Tsukamoto | 355/260 X |
| 5,034,776 | 7/1991 | Sugiura | 355/260 |
| 5,040,024 | 8/1991 | Fukuda et al. | 355/260 |

FOREIGN PATENT DOCUMENTS

| | | |
|---|---|---|
| 097441 | 1/1984 | European Pat. Off. . |
| 58-16655 | 7/1956 | Japan . |
| 58-71756 | 5/1983 | Japan . |
| 64-35574 | 2/1989 | Japan . |
| 64-90470 | 4/1989 | Japan . |

OTHER PUBLICATIONS

English Translation of Patent Abstract (Patent Abstracts of Japan; P-902, Jul. 20, 1989; vol. 13, No. 322.
English Translation of Patent Abstract (Patent Abstract of Japan; P-876, May 24, 1989; vol. 13, No. 222.

*Primary Examiner*—A. T. Grimley
*Assistant Examiner*—Nestor R. Ramirez
*Attorney, Agent, or Firm*—Sandler Greenblum & Bernstein

[57] ABSTRACT

In an electrophotographic image developing device, a toner chamber, for accommodating toner to be used to develop an image, is arranged to be selectively coupled to one of a toner cartridge and an additional toner holding member. The additional toner holding member functions as an expansion of substantial toner accommodating space in the image developing device. In the toner hopper to be coupled with the toner holding member, the upper surface of the toner accommodated therein is leveled before it is transferred to the toner chamber. Alternately, the cartridge is constructed so that it is able to be coupled with the toner hopper.

9 Claims, 11 Drawing Sheets

DEVELOPING DEVICE FOR ELECTROPHOTOGRAPHIC IMAGE RECORDING APPARATUS

BACKGROUND OF THE INVENTION

The present invention relates to a developing device for an electrophotographic image recording apparatus.

Conventionally, an image recording apparatus such as an electronic copy machine, laser beam printer and the like, has been known in which a so-called electrophotographic image forming process is employed.

In the electrophotographic image recording apparatus as described above, an electrostatic latent image is formed by exposing the uniformly charged photoconductive material provided on the circumferential surface of a photoconductive drum. The latent image is developed by applying toner onto the photoconductive material in order to form a toner image. Then the toner image is transferred onto a recording sheet, and the transferred toner image is heated/pressed and fixed thereon.

In such an electrophotographic image recording apparatus, toner filled in a toner chamber of the developing device is magnetically attracted by a developing roller and transported to a developing area. Generally, toner is supplied to the toner chamber by means of a detachable toner cartridge. When using the toner cartridge, stain to the apparatus, due to the leakage of toner, is easily prevented. Further, the toner supply can be easily replenished.

FIG. 1 shows an example of a toner cartridge 20 attached to a developing device 10. A cartridge attachment portion 13 is positioned above the toner chamber 11, to which the toner cartridge 20, filled with toner, is attached. Then the toner, accommodated in the toner cartridge 20, is allowed to fall in the toner chamber 11. In this case, after the toner is supplied to the toner chamber 11, the toner cartridge 20 becomes empty. The empty toner cartridge 20 is used as a cover for the toner chamber 11 until the a new toner cartridge, filled with toner replaces the empty toner cartridge 20.

However, as constructed above, the toner cartridge, after the toner has been transported to the toner chamber remained attached to the developing device in on empty condition. Typically, the cartridge protrudes largely from the upper surface plane of the developing device, whereby, the empty cartridge creates a large uselessly occupied space.

On the other hand, since the processing speed of the image recording apparatus has improved recently, if the capacity of the toner cartridge is relatively small, the cartridge will have to be replaced frequently. If the capacity of the cartridge is made relatively large, so that more image forming process can be done with a single toner supply, the problem resides in that the developing device as well as the toner cartridge will need to be made larger which goes against the recent tendency to make the apparatus compact.

SUMMARY OF THE INVENTION

It is therefore an object of the present invention to provide an improved developing device in which the space occupied by the toner cartridge is efficiently used for accommodating toner so that the number of pages printed by the image recording apparatus, with a single toner supply, can be increased without enlarging the apparatus.

It is another object of the present invention to provide a toner hopper capable of supplying toner to the developing device efficiently.

It is further object of the present invention to provide an improved toner holder which has a mechanism capable of discharging the toner accommodated therein in a leveled manner.

For the above object, according to one aspect of the present invention, there is provided an electrophotographic image developing device including a toner chamber for accommodating toner used to develop an image. The toner chamber is arranged to be selectively coupled to one of a toner cartridge and an additional toner holding member. The additional toner holding member functions to expand a substantial toner accommodating space in the image developing device. If it is required that a relatively large amount of toner should be accommodated in the toner chamber of the developing device, by coupling the additional toner holding member with the developing device, the toner chamber can be easily expanded.

Optionally, the additional toner holding member is formed to be coupled to a toner hopper for supplementing the toner into an additional toner holding member upon consumption of the toner in the toner chamber.

According to another aspect of the invention, there is provided a toner cartridge, holding toner therein, that is arranged to be coupled to a toner hopper holding toner therein, in such a fashion that the toner in the toner hopper is transferred into the toner cartridge upon consumption of the toner in the toner cartridge. With this cartridge, after the toner, accommodated in the cartridge, has been transferred into the toner chamber of the developing device, the toner is transferred in the toner cartridge from the toner hopper. Thus, the space occupied by the toner cartridge is used as a toner accommodating space.

Optionally, there is provided a coupling mechanism for coupling the toner hopper with the toner cartridge.

Further, the additional toner holding member comprises:

an inner member;

an outer member, with the inner and outer members being arranged to have a predetermined gap therebetween, a pair of openings being formed on corresponding portions of the inner member and the outer member; and a shutter member between the pair of openings for opening and closing the pair of openings, the pair of openings being opened when toner is supplied in the developing device.

According to still another aspect of the invention, there is provided a toner hopper holding toner therein, that is arranged to be coupled to a toner chamber of an electrophotographic image developing device in such a fashion that the toner in the toner hopper is transferred into the toner chamber upon consumption of the toner in the toner chamber.

Optionally, the toner hopper comprises a toner discharge port, a gate member arranged at the discharge port moveable between an operable position and an inoperable position. The port allows toner to be discharged therethrough when the gate member is moved to its inoperable position. While the discharge port prevents toner from passing therethrough when the gate member is moved to its operable position.

Further, the gate member comprises an operation portion to be operated to move the gate member, the toner hopper further comprises a removable operating member for contacting the operation member to move the gate member. The gate member is located at the operable position when the removable operating member contacts the operation portion, and the gate member is located at the inoperable position when the removable operating member is removed from the toner hopper.

Furthermore, the gate member comprises a shutter portion extending in the longitudinal direction of the toner discharge port. The gate member is rockable with respect to one lateral end of the shutter portion. The operation portion extends in the longitudinal direction of the toner discharge port, with one lateral end of said operation portion being connected to said shutter portion. The removable operating member extends in the longitudinal direction of the toner discharge port, with the other lateral end of the operation portion contacting the removable operating member the gate member is located at the operated portion as long as the other lateral end of said operation portion contacts at least a part of the removable operating member.

Further optionally, the toner hopper comprises a main vessel for accommodating toner therein, and a leveling device disposed at the upper end of the main vessel for leveling the upper surface of the toner accommodated in the main vessel.

Further, the leveling device comprises:

an upper bellows and a lower bellows capable of expanding and contracting, respectively; and a leveling plate for pressing and leveling the upper surface of the toner accommodated in the main vessel.

The lower end of the lower bellows is connected to the upper end of the main vessel. The lower surface of the leveling plate is connected to the upper end of the lower bellows. The upper surface of the leveling plate is connected to the lower end of the upper bellows. The upper end of said upper bellows is closed.

A plurality of openings are formed on the leveling plate, each of the plurality of openings are covered with a filter member. The filter member allows air to pass therethrough and prevents toner from passing therethrough.

The upper bellows is contracted and the lower bellows is expanded before the upper surface of the toner, accommodated in the main vessel, is leveled. The lower bellows is contracted when the upper surface of the toner, accommodated in the main vessel, is leveled by pressing the leveling plate to the toner. Thereby the air contained in the lower bellows is caused to pass through the plurality of openings covered with the filter members to enable the upper bellows to expand. Thus the upper surface of the toner, accommodated in the toner hopper, is leveled before the toner is transferred into the developing device. Alternately, the upper bellows can be omitted.

According to still another aspect of the invention, there is provided a toner cartridge holding toner that is arranged to be coupled to a toner chamber of an electrophotographic image developing device. The toner cartridge comprises a toner discharge port and a gate member arranged at the discharge port movable between an operable position and an inoperable position. The port allows toner to be discharged therethrough when the gate member is moved to its inoperable position. While the discharge port prevents toner from passing therethrough when the gate member is moved to its operable position.

Optionally, the gate member comprises an operation portion that is operated to move the gate member. The toner cartridge further comprises a removable operating member for contacting the operation member to move the gate member. The gate member is located at the operable position when the removable operating member contacts the operation portion, and wherein the gate member is located at the inoperable position when the removable operating member is completely removed from the toner cartridge.

DESCRIPTION OF THE ACCOMPANYING DRAWINGS

DESCRIPTION OF THE EMBODIMENTS

Figure 1:
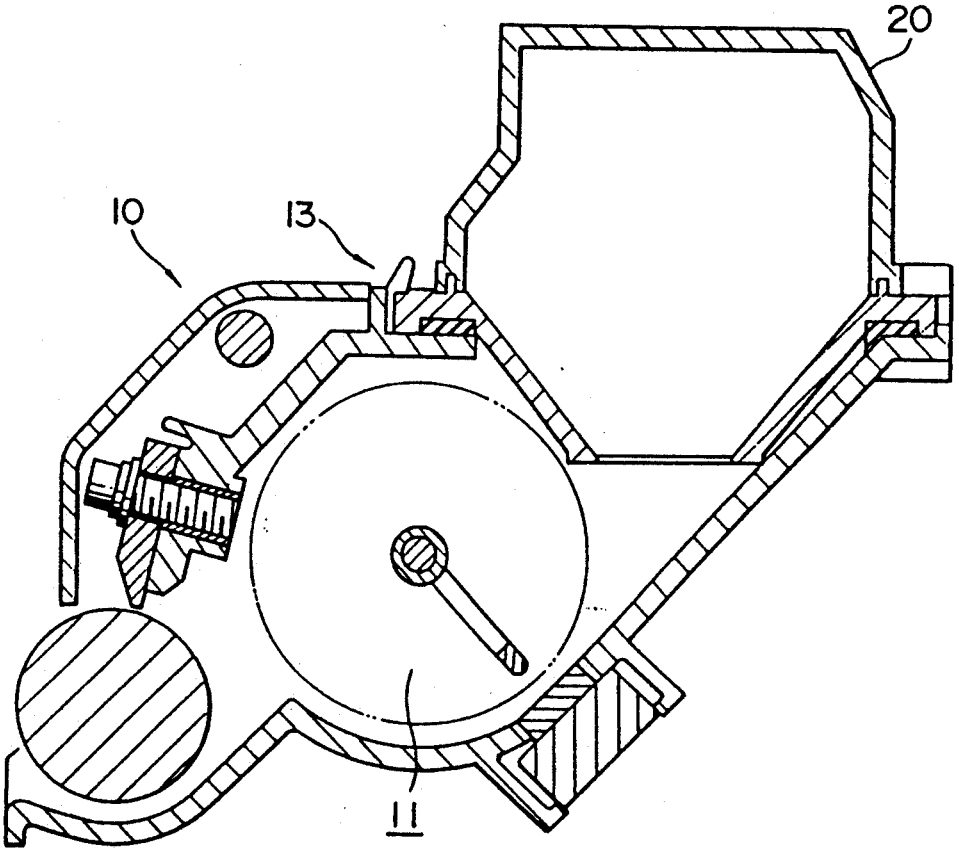
FIG. 1 PRIOR ART
FIG. 1 is a cross-sectional side view of a developing device mounting a conventional toner cartridge.
Figure 2:
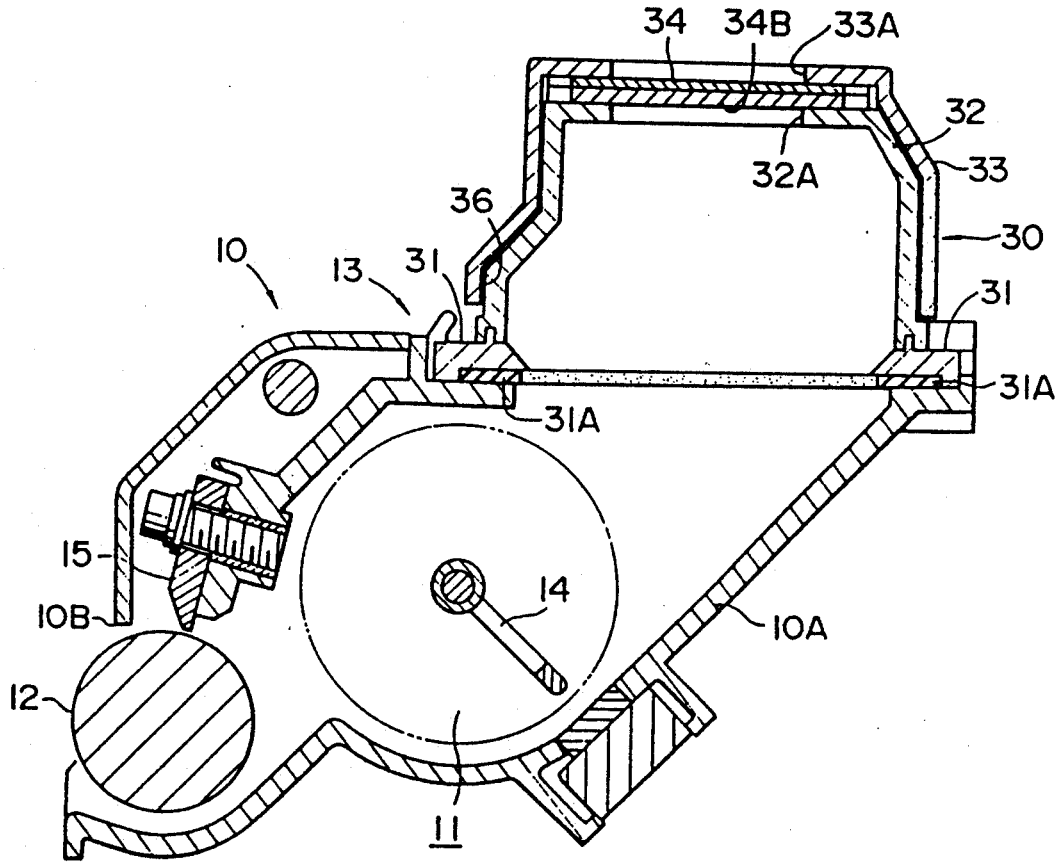
FIG. 2 is a cross-sectional side view of a developing device mounting a toner holding attachment embodying the present invention.

FIG. 2 is a cross-sectional side view of a developing device 10 with a toner accommodation attachment embodying the present invention. The developing device 10 comprises a toner chamber 11, and a developing roller 12 disposed at the obliquely lower position of the toner chamber 11. A toner cartridge attachment portion 13 is defined at the position opposite to the developing roller 12 with respect to the toner chamber 11 (at the obliquely upper position of the toner chamber 11). A conventional toner cartridge can be detachably mounted at the toner cartridge attachment portion 13.

A scraper 14, for supplying the toner to the developing roller 12, is arranged substantially at the center of the toner chamber 11. The axial ends of the developing roller 12 are rotatably held by the case 10A of the developing device 10.

The circumferential surface of the developing roller 12 is exposed to a photoconductive drum, not shown, through the opening 10B, which is formed on the case 10 and extends in the axial direction of the developing roller 12, for supplying the toner to the circumferential surface of the photoconductive drum through the opening 10B. Further, a doctor blade 15 is provided for regulating the amount (height) of toner held on the surface of the developing roller 12.

TONER HOLDING ATTACHMENT

A toner holding attachment 30 is detachably mounted on the case 10A of the developing device 10. It should be noted that the conventional toner cartridge and the toner holding attachment 30 is selectively mounted on the developing device 10 by means of a well-known engaging mechanism positioned around the toner cartridge attachment portion 13.

The toner holding attachment 30 is used for increasing the amount of the toner to be accommodated in the developing device 10.

Figure 3A:
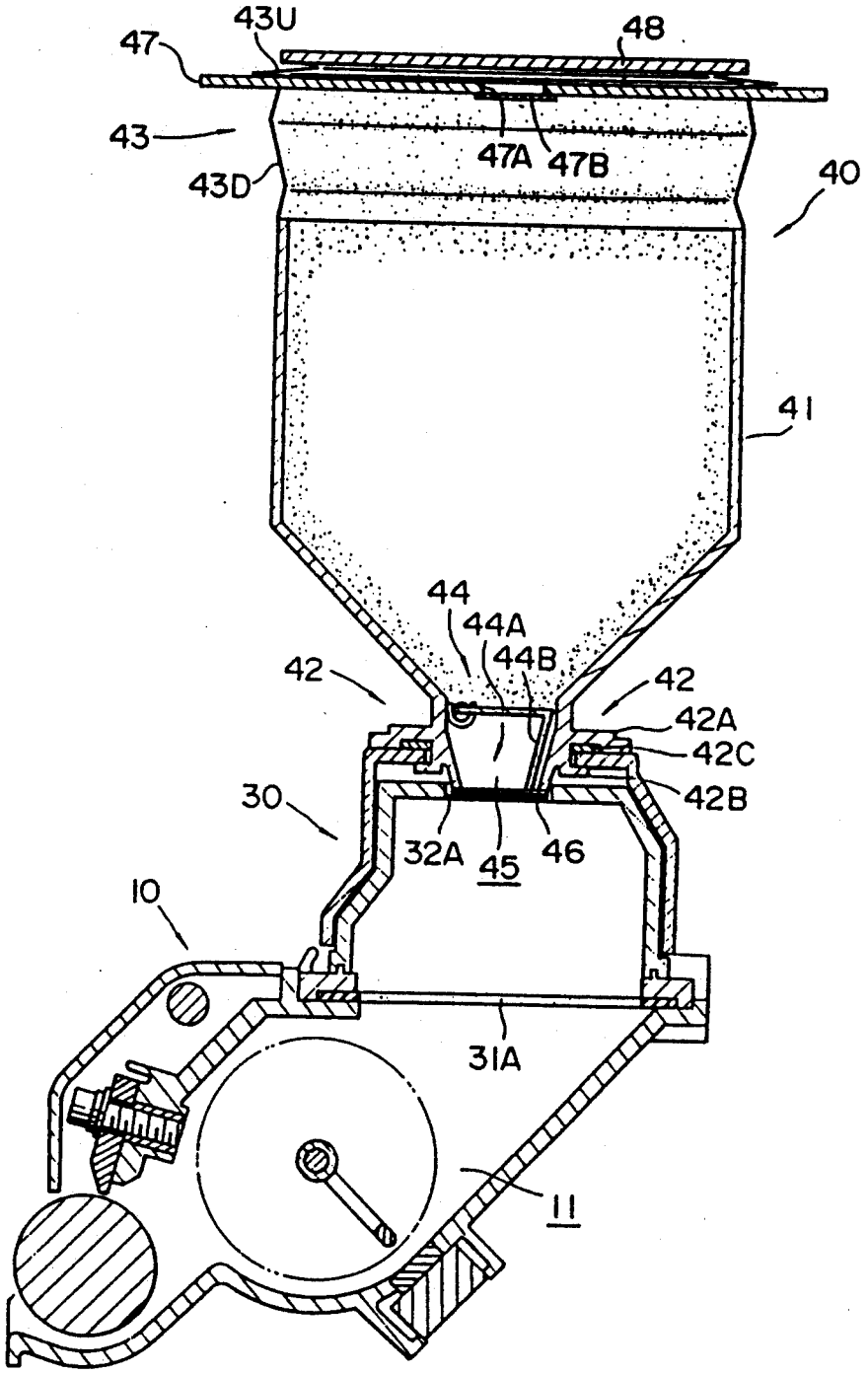
FIG. 3A is a cross-sectional side view of a developing device mounting a toner holding attachment and a toner hopper embodying the present invention.

As shown in FIGS. 2 and 3A, the toner holding attachment 30 is constructed such that an attachment brim 31 is provided around the side wall of the toner holding attachment 30. The upper part of the toner holding attachment with respect to the attachment, brim 31 (an inner member 32), is covered with an outer member 33. The bottom of the toner holding attachment 30 is opened to the toner chamber 11. A seal member 31A is provided in correspondence with the lower surface of the attachment brim 31.

The outer member 33 is fixedly fitted to the inner member 32 with a seal member 36 therebetween. The member 36 surrounds the inner member 32 at its lower side portion, so that the outer surface of the inner member 32 and the inner surface of the outer member 33 are apart from each other by a predetermined gap. On the upper walls of the inner member 32 and outer member 33, toner supply ports 32A and 33A are correspondingly positioned. Further, a shutter plate 34, slidable in the lateral direction of the toner holding attachment 30, is provided between the outer surface of the upper wall of the inner member 32 and the lower surface of the upper wall of the outer member 33.

The shutter plate 34 is formed to be wider than the toner supply ports 32A and 33A. When the shutter plate 34 is located at the position where the toner supply ports 32A and 33A are closed, one end portion 34A of the shutter plate 34, protrudes through a slit 33B defined on one end of the outer member 33. By operating the protruded portion 34A to slide the shutter plate 34, the toner supply port 32A can be opened or closed (see FIG. 5). On the inner member side surface of the shutter plate 34, an elastic seal member 34B is adhered such that the seal member 34B closely contacts the upper surface of the inner member 32 when the shutter plate 34 is located at the position where the shutter plate 34 closes the toner supply port 32A. Thus, the developing device 10 is tightly closed.

When the toner holding attachment 30, described as above, is mounted at the attachment portion 13 of the developing device 10, the toner holding attachment 30 is connected with the toner chamber 11. Accordingly, the developing device 10, mounting the toner holding attachment 30, is capable of accommodating the toner, corresponding to the capacity of the toner chamber 11 and to the space occupied by the toner holding attachment 30. In other words, the toner holding attachment 30 cooperates with the toner chamber 11 to increase the amount of the toner to be accommodated in the developing device 10.

When the shutter plate 34 is slid so that the toner supply ports 32A and 33A are opened, toner can be supplied in the toner chamber 11 and the toner holding attachment 30 through the toner supply ports 32A and 33A. Thus the space corresponding to the space occupied by the toner holding attachment 30, or the space which has been occupied by the empty toner cartridge, can be efficiently used as a toner container. In other words, the capacity of the developing device 10 becomes the sum of the capacity of the toner chamber 11 together with the capacity of the toner holding attachment 30. In the present embodiment, since the capacity of the toner accommodation attachment 30 is substantially the same as that of the toner cartridge, the number of pages to be printed by the recording apparatus with a single supplying operation of the toner, by means of above described developing device 10 mounting the toner holding attachment 30, is twice as that of the developing device mounting a conventional toner cartridge. In other words, space having been occupied by the toner cartridge is turned into the space for accommodating toner. Thus, the number of pages to be printed with a single toner supply can be increased.

TONER HOPPER

Figure 3B:
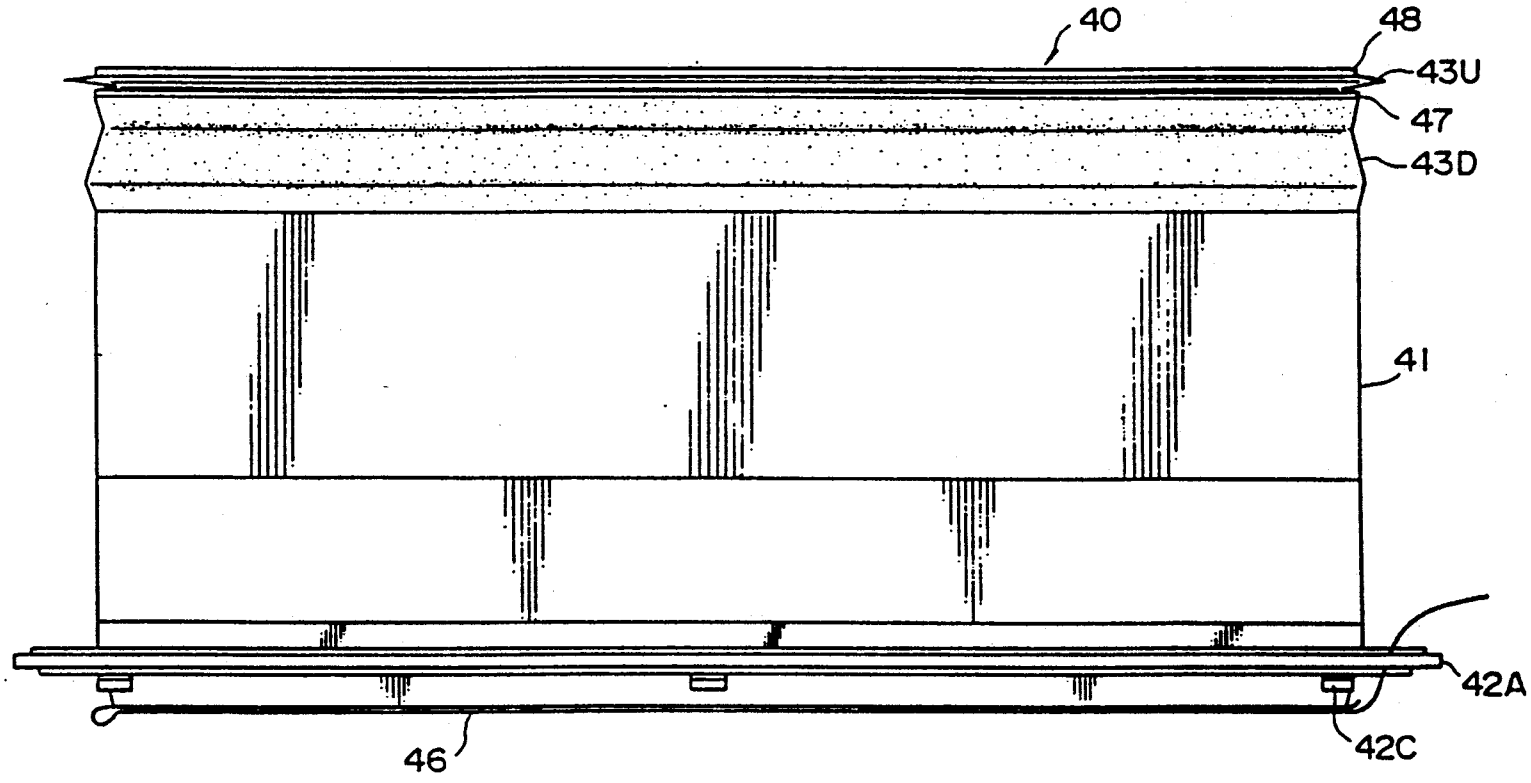
FIG. 3B is a plan view of the toner hopper of FIG. 3A.

FIG. 3A shows the developing device 10, mounting the toner holding attachment 30, and a toner hopper 40 for supplying toner into the developing device 10. FIG. 3B is a front view of the toner hopper 40. The toner hopper 40 is capable of accommodating the toner corresponding to the capacity of the toner chamber 11 and that of the toner holding attachment 30. The toner hopper 40 is to be attached to the toner supply port 33A of the toner holding attachment 30, when the toner is supplied.

The lower side of a main vessel 41 of the toner hopper 40 is formed to be funnel-shaped. At the tip of the funnel-shaped portion (the lowermost end of the vessel 41), an attachment portion 42, to be engaged with the toner holding attachment 30, is formed. On the upper side of the toner hopper 40, a toner leveling mechanism 43 is provided. Note that the vessel 41 is made of an elastic material having a predetermined elasticity such as plastic.

The attachment portion 42 is constructed such that a toner supply opening 45 is defined at the lowermost end of the funnel-shaped portion which is capable of fitting to the toner supply port 32A defined on the toner holding attachment 30. An attachment brim 42A is projectingly formed around the lower end of the funnel-shaped portion. The attachment brim 42A is to be held abutted against the upper surface of the outer member 33 of the toner holding attachment 30. Further, a plurality of engaging protrusions 42B are outwardly provided on the peripheral surface of the funnel-shaped portion, on the lower end side with respect to the attachment brim 42A. At the toner supply opening, a shutter member 44 is provided.

The shutter member 44 has a substantially L-shaped cross-section. An operation knob 44B is formed at the lateral end of a shuttering portion 44A, such that the operation knob 44B and the shuttering portion 44A are at a right angle to each other. The shutter member 44 is arranged to be rockable with respect to the other end of the shuttering portion 44A. The movable free end of the operation knob 44B is located in the toner supply opening 45.

The toner supply opening 45 is covered with a seal tape 46 utilized as an opening regulating member. The seal tape 46 is arranged such that it closes the toner supply opening 45. The seal tape is bent back at the lateral end of the toner supply opening 45 and then folded. The tip of the folded portion of the seal tape 46 passes through a slit defined on the attachment brim 42A and extends therefrom (see FIG. 3B). By pulling this extending portion of the seal tape 46, the seal tape 46 is gradually removed from the lateral end of the toner supply opening 45, where the seal tape 46 is bent back. Since the free end of the operation knob 44B is held abutted against the inner surface of the seal tape 46, the rocking movement, due to the dead weight of the shutter member 44 and the weight of the toner thereon, is prevented even if a part of the seal tape 46 is removed from the toner supply opening 45. With this condition, the shuttering portion 44A closes the toner supply opening 45.

A pair of bellows members 43D and 43U, made of resin having a predetermined elasticity, are mounted on the upper end of the main vessel 41. A leveling plate 47, for leveling the upper surface of the toner accommodated in the toner hopper, is arranged between the bellows 43D and 43U. The upper end of the upper bellows 43U is closed with a top board 48.

On the leveling plate 47, a plurality of air holes 47A are formed. A filter 47B is adapted to each of the air holes 47A. The filter 47B allows the air to pass through and prevents the toner from passing through.

When the toner is leveled, the upper surface of the toner, fully accommodated in the toner hopper 40, is substantially in the same plane of the upper end of the main vessel 41. In this condition, the amount of the toner accommodated in the toner hopper 40 corresponds to the sum of the capacity of the toner chamber 11 and the toner holding attachment 30.

When the toner is accommodated in the toner hopper 40, as shown in FIG. 3A, the lower bellows 43D is expanded, and the upper bellows 43U is contracted. It should be noted that the capacity of the main vessel 41, i.e., the amount of the toner accommodated in the toner hopper 40, is set to 80 percent of the sum of the capacity of the main vessel 41 and that of the expanded lower bellows 43D.

Figure 4A:
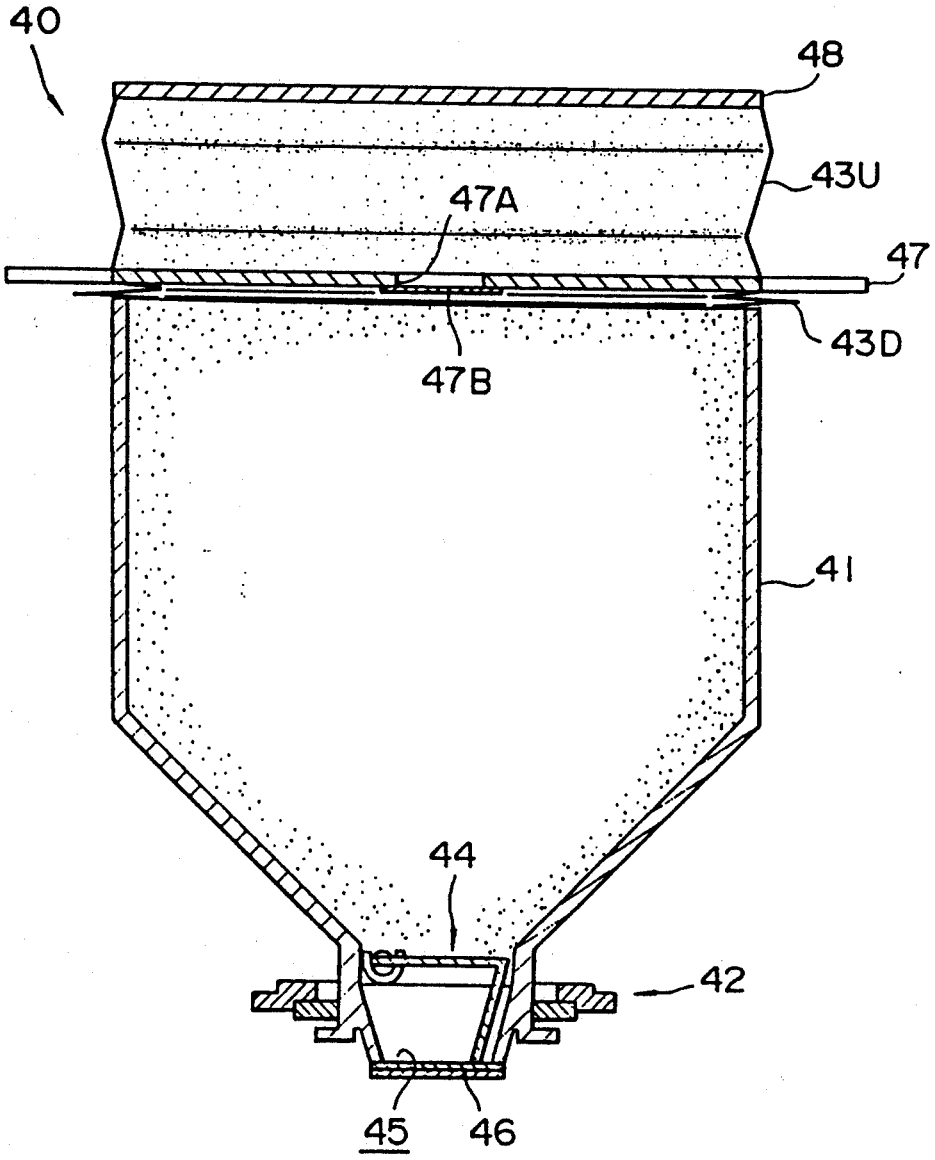
FIGS. 4A and 4B are cross-sectional side views of the toner hopper.
Figure 4B:
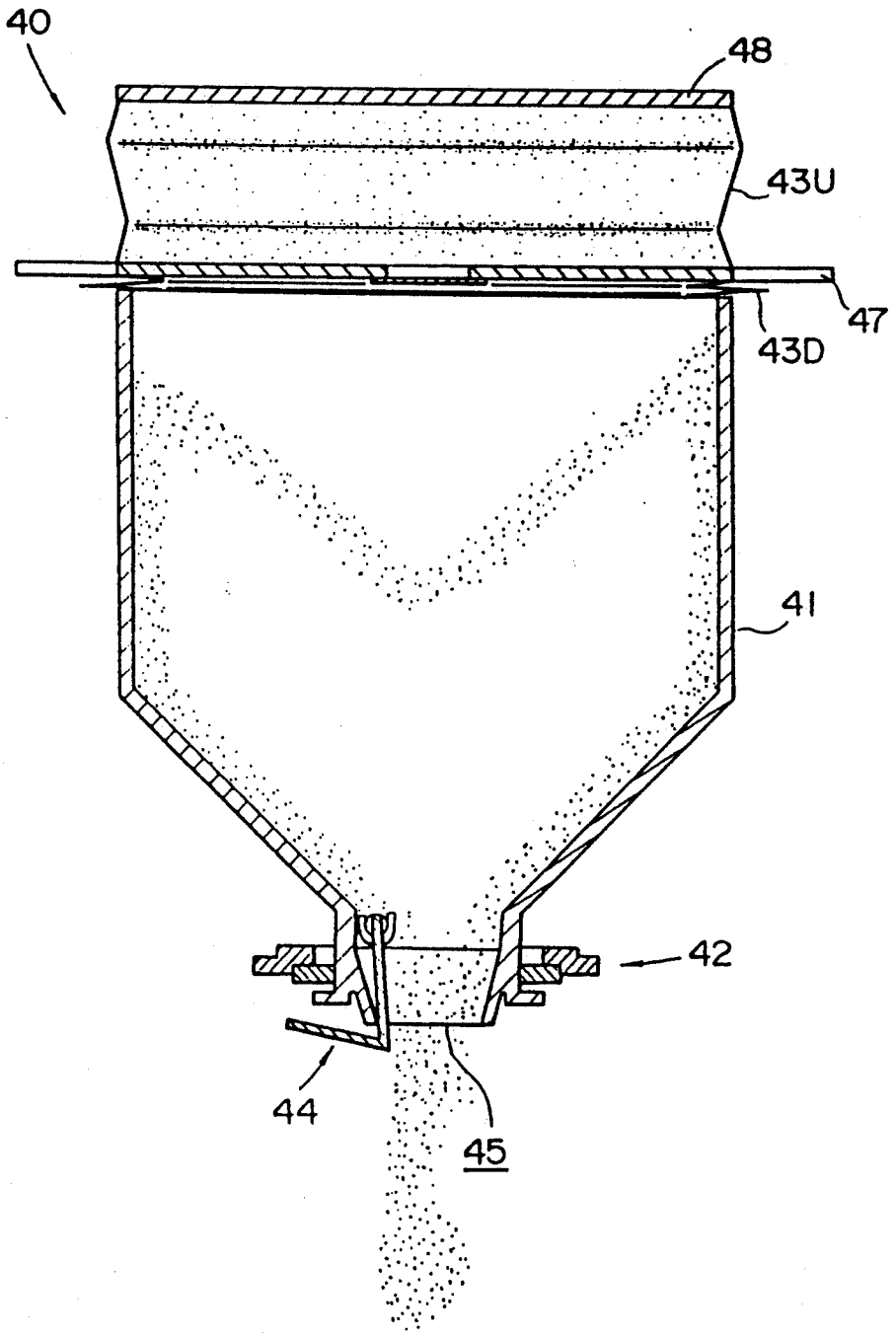
Figure 4C:
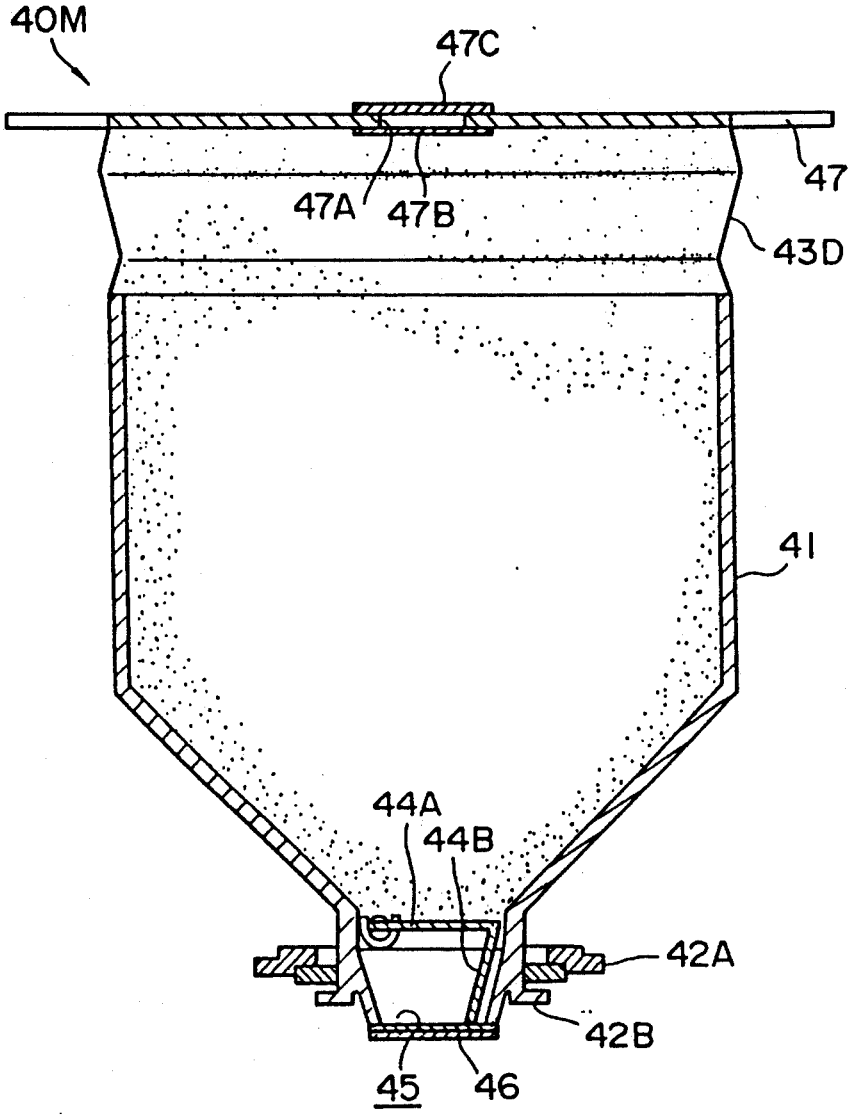
FIG. 4C shows a cross-sectional side view of a modified toner hopper.

FIG. 4C shows a cross-sectional side view of a modified toner hopper 40M. The modified toner hopper 40M has substantially the same construction of the toner hopper 40 except that the upper bellows 43U of the toner hopper 40 is omitted.

Constructed as above, when the leveling plate 47 is moved toward the main vessel 41 in order to level the upper surface of the toner, the air accommodated inside the lower bellows 43D is expelled through the filters 47B. In order to prevent the unsupplied toner from getting damp, the air holes 47A are preferably covered with a seal tape 47C. When the toner is supplied, the seal tape 47C is removed, the leveling plate 47 is moved downward, and then the seal tape 46 is removed.

Figure 5:
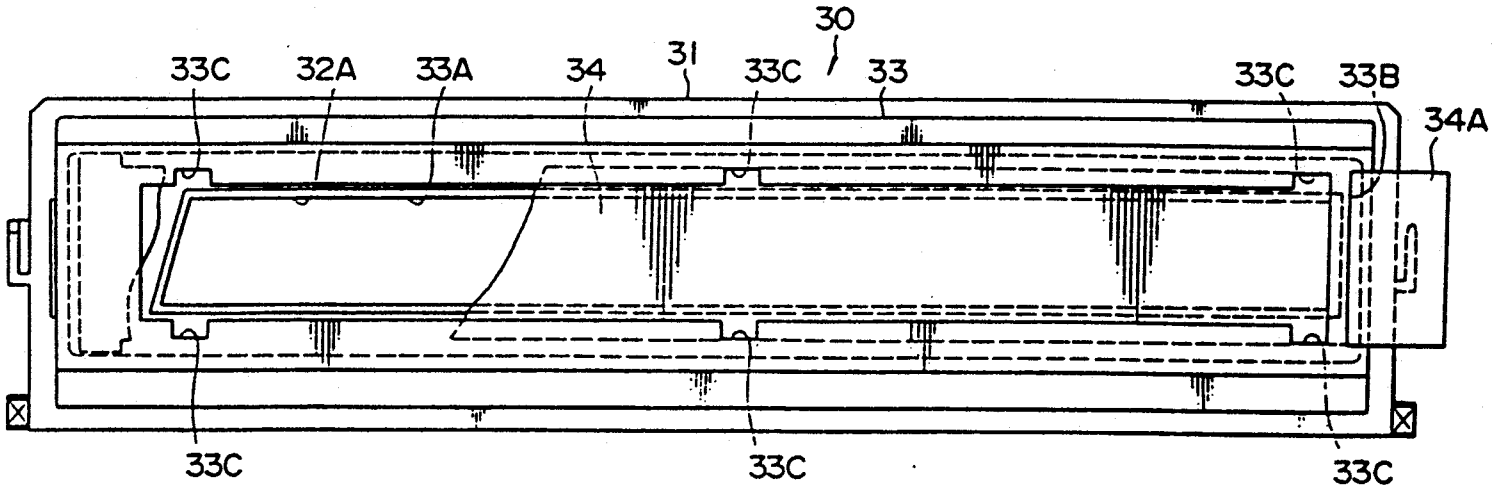
FIG. 5 shows a bottom end view of the toner hopper of FIG. 3B.

FIG. 5 is a top view of the toner holding attachment 30.

On the outer member 33, around the toner supply ports 33A, a plurality of cutouts 33C are formed at the positions corresponding to the engaging protrusions 42B of the toner hopper 40 so that the protrusions 42B are fitted in said cutouts 33C.

The toner hopper 40 is attached to the toner holding attachment 30 as follows. First, the shutter plate 34 is slid and the toner supply ports 32A is opened. Second, the attachment portion 42 of the toner hopper 40 is fitted in the toner supply ports 32A with the engaging protrusions 42B corresponding to the cutouts 33C. By sliding the toner hopper 40 in the lateral direction thereof with the lower surface of the attachment brim 42A contacting the upper surface of the toner holding attachment 30, the toner hopper 40 is fixedly engaged with the toner holding attachment 30. In this condition, since the toner supply port 33A is covered with the attachment portion 42, and since an sealing member 42C is arranged between the attachment brim 42A and the upper surface of the outer member 33 the toner hopper 40 is attached in an airtight relationship to the toner holding attachment 30.

When the leveling plate 47 is pressed toward the main vessel 41, as shown in FIG. 4A, the lower bellows 43D contracted and the air accommodated therein is moves through the filters 47B to the upper bellows 43U. Accordingly, the upper bellows 43U is expanded as the air is flown thereinto. Thus, the upper surface of the toner, accommodated in the main vessel 41, is substantially evenly leveled by the leveling plate 47 along the plane, including the upper end of the main vessel 41. Then, as shown in FIG. 4B, the rocking motion of the shutter member 44 is facilitated by removing the seal tape 46 which covers the toner supply opening. Thus the shutter member 44 is rocked and the toner supply opening 45 is opened. The toner accommodated in the toner hopper 40 is supplied to the toner chamber 11 and inside the toner holding attachment 30.

It should be noted that the shutter member 44 rocks, or the toner supply opening 45 is opened when the seal tape 46 is completely removed. Since the movement of the extreme end of the operation knob 44B is restricted by the seal tape 46, the shutter member 44 never moves as long as a part of the seal tape 46 is not removed. When the seal tape 46 is completely removed from the toner supply opening 45, the toner is simultaneously supplied through any longitudinal portion of the toner supply opening 45 to the toner chamber 11 and inside the toner holding attachment 30.

Since the upper surface of the toner, accommodated in the toner hopper 40, is leveled by the leveling plate 47, as aforementioned, and further, any longitudinal portion of the toner supply opening 45 is simultaneously opened with use of the shutter member 44, the toner is supplied to the toner holding attachment 30 and the toner chamber 11 evenly in the longitudinal direction of the toner supply opening 45. Thus, the toner does not remain unsupplied in the toner hopper 40, and efficiently supplied to the developing device.

After the toner has been supplied to the developing device 10, i.e., to the toner chamber 11 and inside the toner holding attachment 30, the toner hopper 40 is slid and disengaged from the toner holding attachment 30. Then the shutter plate 34 is slid in order to close the toner supply ports 32A and 33A.

TONER CARTRIDGE

Figure 6:
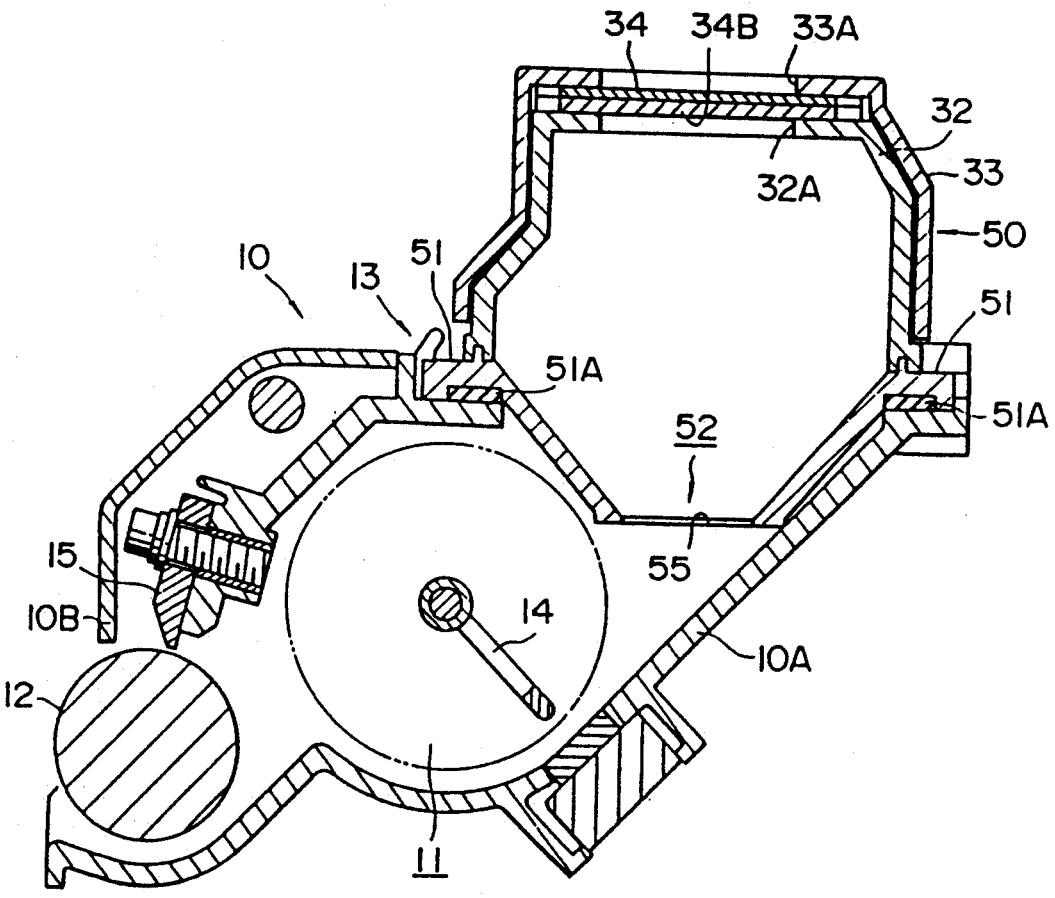
FIG. 6 is a cross-sectional side view of a developing device mounting a toner cartridge having a toner supply port, which is a second embodiment of the present invention.

FIG. 6 shows a cross-sectional side view of the developing device 10 mounting a toner cartridge 50 as a second embodiment according to the present invention. The toner cartridge 50 is detachably mounted on the developing device 10 by means of a well-known engaging mechanism as is employed in the conventional developing device.

The toner cartridge 50 is formed as a rectangular parallelepiped, which is substantially the same configuration as the conventional toner cartridge.

Around the side wall of the toner cartridge 50, an attachment brim 51, for engaging with the cartridge attachment portion 13, is provided.

The lower side (the toner chamber 11 side) of the toner cartridge 50 projects by a predetermined amount with respect to an plane including the attachment portion 13 and is formed to be funnel-shaped. At the tip of the funnel-shaped projected portion, i.e., the lowermost end of the toner cartridge 50, a toner supply port 52 is defined, which extends in the direction parallel to the rotational axis of the developing roller 12. The supply port 52 is sealed with a seal tape 55 with toners being accommodated inside the cartridge 50. When the toner cartridge 50 is attached at the attachment portion 13, the funnel-shaped portion is located inside the toner chamber 11. In this case, when the seal tape 55 is removed, the toner supply port 52 is opened, thus toner accommodated in the toner cartridge 50 fallen inside the toner chamber 11.

Note that a sealing member 51A, such as a sponge, is provided on the developing device 10 side at the attachment portion 13. The position of the sealing member 51A is in correspondence with the attachment brim 51 of the toner cartridge 50.

Figure 7:
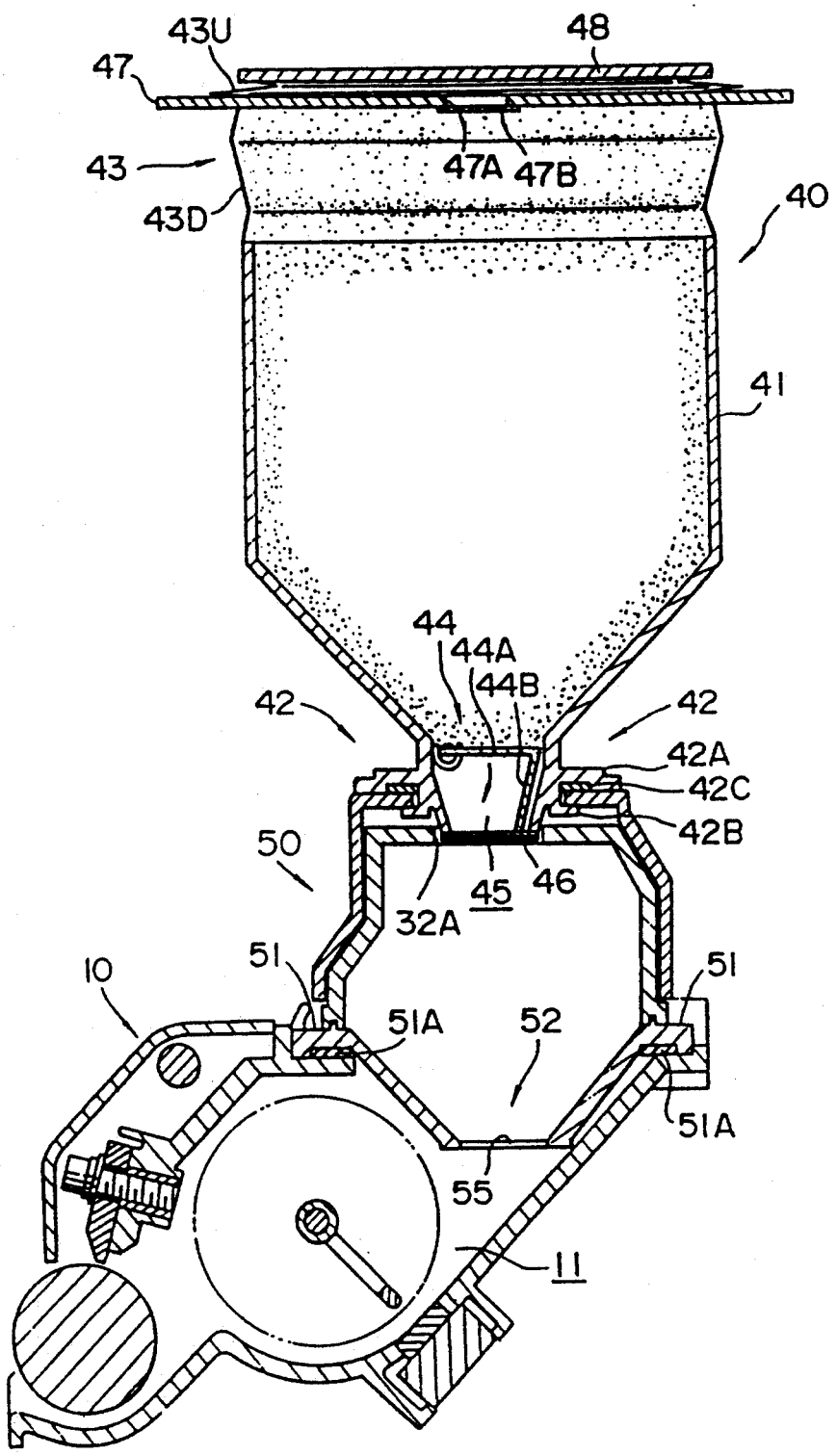
FIG. 7 is a cross-sectional side view of a developing device mounting a toner cartridge as a second embodiment of the invention to which the toner hopper can be attached.

The upper portion of the toner cartridge 50 is constructed similar to the toner holding attachment 30. Accordingly, as shown in FIG. 7, the toner hopper 40 can be attached to the toner cartridge 50.

When a malfunction of the developing device 10 occurs, the toner cartridge 50 may be removed from the developing device 10 for maintenance of the developing device 10. In this case, if the toner cartridge 50 is filled with the toner, the toner, accommodated in the cartridge 50, leaks when removed from the developing device. In such a case, the shutter plate 34 is operated to open the toner supply ports 32A and 33A, then the toner accommodated in the toner cartridge 50 is taken away before the toner cartridge 50 is removed from the developing device 10. Thus, the toner cartridge 50 can be removed without leakage of the toner from the cartridge 50.

Figure 8:
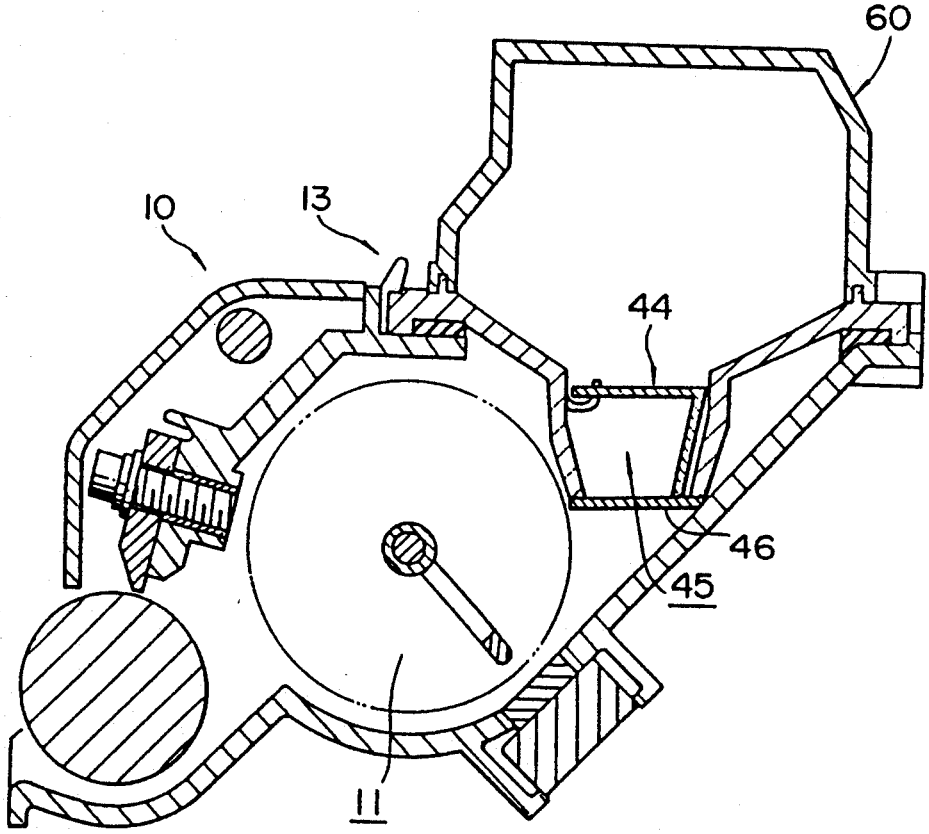
FIG. 8 is a cross-sectional side view of a developing device mounting a modified toner cartridge.

FIG. 8 is a cross-sectional view of a developing device mounting a modified toner cartridge 60. The toner cartridge 60 is substantially the same configuration as the conventional cartridge 20 except that the shutter member 44, which is similar to that of the toner hopper 40, is provided at the bottom thereof. Thus constructed, the shutter member 44 closes the toner supply opening 45 as long as a part of the seal remains unremoved. When the seal tape 46 is completely removed from the cartridge 60, the shutter member 44 rocks and then opens the toner supply opening, whereby toner, accommodated in the cartridge 60 is allowed to fall into the toner chamber. Constructed as above, the toner, accommodated in the cartridge 60, is supplied to the toner chamber simultaneously at any longitudinal portion of the toner supply opening 45. Accordingly, the toner is supplied evenly in the longitudinal direction of the toner chamber 11.

As above, with the toner holding attachment according the present invention, the capacity of the developing device can be increased only by replacing a toner cartridge with a toner holding attachment. Thus, the number of pages to be printed with a single toner supply can be increased.

Further, according to the present invention, the toner, accommodated in a toner hopper, can be evenly and efficiently supplied to the developing device. Thereby the number of pages printed by a recording apparatus can be increased.

Still further, with a mechanism for discharging toner according to the present invention, the toner accommodated in a toner holding member, such as a toner cartridge, can be discharged evenly in the longitudinal direction of the toner supply port thereof.

Furthermore, in the conventional developing device, the toner cartridge, after the toner has been supplied from the cartridge to the toner chamber, uselessly occupies a considerable space. According to the present invention, when the toner cartridge is constructed as above, the space occupied by the toner cartridge is efficiently used as a space for accommodating the toner.

The present disclosure relates to subject matters contained in Japanese Utility Model Applications Nos. HEI 2-68317, HEI 2-70604, and Japanese Patent Application No. HEI 2-219340 (filed on Jun. 27, 1990, Jul. 2, 1990, and Aug. 21, 1990, respectively) which are expressly incorporated herein by reference in their entirety.

What is claimed is:

1. A toner hopper holding toner therein, comprising a toner discharge port extending in a longitudinal direction and having a predetermined length, a gate member arranged at said discharge port being rockable between an operable position and an inoperable position, said port allowing toner to be discharged therethrough along said predetermined length substantially upon rocking movement of said gate member to its inoperable position, while said discharge port prevents toner from passing therethrough when said gate member is located at its operable position.

2. The toner hopper according to claim 1, wherein said gate member comprises an operation portion operated to move said gate member, wherein said toner hopper further comprises a removable operating member for contacting said operation portion to move said gate member, wherein said gate member is located at said operable position when said removable operating member contacts said operation portion, and wherein said gate member is located at said inoperable position when said removable operating member is removed from said toner hopper.

3. The toner hopper according to claim 2, wherein said gate member comprises a shutter portion extending in the longitudinal direction of said toner discharge port, said gate member being rockable with respect to one lateral end of said shutter portion, wherein said operation portion extends in the longitudinal direction of said toner discharge port, one lateral end of said operation portion being connected to said shutter portion, and wherein said removable operating member extends in the longitudinal direction of said toner discharge port, the other lateral end of said operation portion contacts said removable operating member, whereby said gate member is located at said operation portion as long as said other lateral end of said operation portion contacts at least a part of said removable operating member.

4. The toner hopper according to claim 1, which further comprises a main vessel for accommodating toner therein, and leveling means disposed at the upper end of said main vessel for leveling the upper surface of the toner accommodated in said main vessel.

5. The toner hopper according to claim 4, wherein said leveling means comprises:

an upper bellows and a lower bellows capable of expanding and contacting, respectively; and a leveling plate for pressing and leveling the upper surface of the toner accommodated in said main vessel, wherein the lower end of said lower bellows is connected to the upper end of said main vessel, the lower surface of said leveling plate being connected to the upper end of said lower bellows, the upper surface of said leveling plate being connected to the lower end of said upper bellows, the upper end of said upper bellows being closed, wherein a plurality of openings are formed on said leveling plate, each of said plurality of openings being covered with a filter member, said filter member allowing air to pass therethrough and preventing toner from passing therethrough, and wherein said upper bellows is contracted and said lower bellows is expanded before the upper surface of the toner accommodated in said main vessel in leveled, said lower bellows being contracted when the upper surface of the toner, accommodated in said main vessel, is leveled by pressing said leveling plate to the toner, thereby the air contained in said lower bellows passes through said plurality of openings, that are covered with said filter member, to enable said upper bellows to expand.

6. The toner hopper according to claim 4, wherein said leveling means comprises:

a leveling plate for pressing and leveling the upper surface of the toner accommodated in said main vessel; and a bellows provided between said leveling plate and said main vessel, said bellows being capable of being contracted and expanded by said leveling plate, wherein the lower end of said lower bellows is connected to the upper end of said main vessel, the lower surface of said leveling plate being connected to the upper end of said lower bellows, wherein a plurality of openings are formed on said leveling plate, each of said plurality of openings being covered with a filter member, said filter member allowing air to pass therethrough and preventing toner from passing therethrough, and wherein said lower bellows is expanded before the upper surface of the toner, accommodated in said main vessel, is leveled, said lower bellows being contracted when the upper surface of the toner, accommodated in said main vessel, is leveled by pressing said leveling plate to the toner, thereby the air contained in said lower bellows being discharged through said plurality of that are covered with said filter members.

7. A toner cartridge holding toner therein, arranged to be coupled to a toner chamber of an electrophotographic image developing device having a photoconductive element, said photoconductive element having an axial direction, said toner cartridge comprising:

a toner discharge port having an axis extending in said axial direction of said photoconductive element; and a gate member arranged at said discharge port being rockable between an operable position and an inoperable position, said port allowing toner to be discharged therethrough substantially simultaneously along said axis upon rocking movement of said gate member to its inoperable position, while said discharge port prevent toner from passing therethrough when said gate member is located at its operable position.

8. The toner cartridge according to claim 7, wherein said gate member comprises an operation portion operated to move said gate member, wherein said toner cartridge further comprises a removable operating portion for contacting said operation member to move said gate member, wherein said gate member is located at said operable position when said removable operating member contacts said operation portion, and wherein said gate member is located at said inoperable position when said removable operating member is removed from said toner cartridge.

9. A toner hopper holding toner therein, comprising an elongated toner discharge port having an axis, a gate member arranged at said discharge port being rockable between an operable position and an inoperable position, said port allowing toner to be discharged therethrough substantially simultaneously along said axis upon rocking movement of said gate member to its inoperable position, while said discharge port prevents toner from passing therethrough when said gate member is located at its operable position.

* * * * *

UNITED STATES PATENT AND TRADEMARK OFFICE

CERTIFICATE OF CORRECTION

PATENT NO. : 5,249,020

DATED : September 28, 1993

INVENTOR(S) : Masatoshi Takano

It is certified that error appears in the above-indentified patent and that said Letters Patent is hereby corrected as shown below:

Column 12, line 3, insert —openings— after "of".
Column 12, line 19, change "prevent" to —prevents—.

Signed and Sealed this

Seventeenth Day of October, 1995

Bruce Lehman

*Attest:*

BRUCE LEHMAN

*Attesting Officer*

*Commissioner of Patents and Trademarks*